US010982499B2

(12) United States Patent
AlShuraim

(10) Patent No.: US 10,982,499 B2
(45) Date of Patent: Apr. 20, 2021

(54) CASING PATCH FOR LOSS CIRCULATION ZONE

(71) Applicant: Saudi Arabian Oil Company, Dhahran (SA)

(72) Inventor: Fawaz Musaad AlShuraim, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 13 days.

(21) Appl. No.: 16/130,735

(22) Filed: Sep. 13, 2018

(65) Prior Publication Data

US 2020/0088002 A1 Mar. 19, 2020

(51) Int. Cl.

| | |
|---|---|
| ***E21B 29/10*** | (2006.01) |
| ***E21B 33/124*** | (2006.01) |
| ***E21B 33/13*** | (2006.01) |
| ***E21B 43/10*** | (2006.01) |

(52) U.S. Cl.

CPC ..... *E21B 29/10* (2013.01); *E21B 33/124* (2013.01); *E21B 33/13* (2013.01); *E21B 43/105* (2013.01)

(58) Field of Classification Search

CPC .... E21B 43/105; E21B 43/103; E21B 43/108; E21B 29/10; E21B 21/003; E21B 43/025

See application file for complete search history.

(56) References Cited

U.S. PATENT DOCUMENTS

| | | | | |
|---|---|---|---|---|
| 3,818,998 | A | 6/1974 | Hessert | |
| 4,191,254 | A | 3/1980 | Baughman et al. | |
| 4,501,327 | A * | 2/1985 | Retz | E21B 17/00 138/98 |
| 4,989,673 | A | 2/1991 | Sydansk | |
| 5,785,120 | A | 7/1998 | Smalley et al. | |
| 5,833,001 | A * | 11/1998 | Song | E21B 33/13 166/287 |
| 6,218,343 | B1 | 4/2001 | Burts, Jr. | |
| 7,066,285 | B2 | 6/2006 | Shaarpour | |
| 7,082,998 | B2 | 8/2006 | Zamora et al. | |
| 7,533,731 | B2 | 5/2009 | Corre et al. | |
| 8,132,623 | B2 | 3/2012 | Allin et al. | |
| 8,739,408 | B2 | 6/2014 | Duan et al. | |
| 8,800,650 | B2 * | 8/2014 | Spray | E21B 43/103 166/207 |
| 8,939,222 | B2 | 1/2015 | Ren et al. | |
| 9,016,365 | B2 * | 4/2015 | Kang | E21B 23/04 166/100 |

(Continued)

FOREIGN PATENT DOCUMENTS

| | | |
|---|---|---|
| EP | 2312119 | 4/2011 |

OTHER PUBLICATIONS

International Search Report and Written Opinion in PCT Appln. No. PCT/US2019/050554, dated Dec. 4, 2019, 12 pages.

(Continued)

*Primary Examiner* — Kipp C Wallace

(74) *Attorney, Agent, or Firm* — Fish & Richardson P.C.

(57) ABSTRACT

A polymer patch system and method associated with a casing to be installed in a wellbore. The polymer patch has a polymer layer and an internal space radially under the polymer layer to form an internal annulus between the polymer layer and an exterior surface of the casing. An internal support is disposed in the internal space to maintain the internal annulus between the polymer layer and the casing.

25 Claims, 5 Drawing Sheets

(56) References Cited

U.S. PATENT DOCUMENTS

| | | | | |
|---|---|---|---|---|
| 9,470,059 | B2 | 10/2016 | Zhou | |
| 2005/0155773 | A1* | 7/2005 | Wetzel | E21B 43/105 166/381 |
| 2007/0107898 | A1 | 4/2007 | Baycroft et al. | |
| 2008/0110616 | A1* | 5/2008 | Nobileau | E21B 43/103 166/207 |
| 2010/0084135 | A1 | 4/2010 | Esmail | |
| 2012/0097391 | A1 | 4/2012 | Whiddon | |
| 2013/0068478 | A1 | 3/2013 | Allen et al. | |
| 2013/0341005 | A1* | 12/2013 | Bruce | E21B 43/08 166/207 |
| 2014/0024276 | A1 | 1/2014 | Hood et al. | |
| 2015/0068764 | A1* | 3/2015 | Lastra | E21B 23/01 166/378 |
| 2016/0230496 | A1* | 8/2016 | Lastra | E21B 23/01 |
| 2018/0187492 | A1 | 7/2018 | Amr et al. | |

OTHER PUBLICATIONS

Gulf Cooperation Council Examination Report issued in GCC Application No. GC 2019-38280 dated Jun. 20, 2020, 4 pages.

* cited by examiner

CASING PATCH FOR LOSS CIRCULATION ZONE

TECHNICAL FIELD

This disclosure relates to a polymer patch system dedicated on a casing to be applied to a formation for a loss circulation zone.

BACKGROUND

In oil or gas well drilling, loss circulation occurs when drilling fluid (mud) or cement slurry flows into the geological formation instead of flowing up the annulus between the formation and the casing or work string. Loss circulation is the partial or complete loss of drilling fluid or cement slurry to the formation during drilling or cementing operations. Loss circulation can be brought on by natural or induced causes. Natural causes include naturally fractured formations or unconsolidated zones. Induced losses occur when the hydrostatic fluid column pressure exceeds the fracture gradient of the formation and the formation pores break down enough to receive rather than resist the fluid. For non-cavernous formations, a loss circulation zone may be the result of fractures in the geological formation at the borehole or wellbore. When loss circulation occurs, both drilling fluid and cement slurry can be lost.

In cementing, the cement slurry may be pumped from the surface down the interior of the casing and then upward from the bottom through the annulus between the casing and the formation. When the cement reaches the loss circulation zone, the cement does not adequately continue upward. Some practices to cement the casing in the presence of a loss circulation zone are to pump the cement slurry to the loss circulation zone and (1) execute a top job on a bridge plate or cement basket, or (2) deploy two-stage cement via a differential valve (DV) tool. In both cases, the interval of exterior casing opposite the loss circulation zone generally receives inadequate or no cement and is thus exposed to formation fluids and potential future corrosion risk. The casing surface area in the loss circulation zone may not be cemented or only partially cemented because the cement path was into the loss zone. A top job or pumping through the DV may be applied where the cement is pumped from top down to the loss circulation zone exposing the casing section adjacent the zone to formation fluids.

SUMMARY

An aspect relates to a polymer patch system to be disposed built-in on a casing. The polymer patch system has a polymer layer, an upper elastomer seal, and a lower elastomer seal. The polymer patch system has an internal space radially under the polymer layer to form an internal annulus between the polymer layer and an exterior surface of the casing. An internal support is disposed in the internal space to maintain the internal annulus between the polymer layer and the casing.

Another aspect relates to a casing for a wellbore. The casing has a polymer patch disposed on an outer diameter (OD) of the casing and to be mechanically activated to radially displace polymer against a formation fracture in a loss circulation zone of the wellbore. The polymer patch has the polymer to be radially displaced to isolate the formation fracture, elastomer seals to isolate the formation fracture, a patch annulus to be expanded to route a flowing cement slurry for cementation, and an internal support disposed in the patch annulus.

Yet another aspect relates to a method of isolating a formation fracture in a loss circulation zone in a wellbore, including lowering a casing having a polymer patch system into the wellbore to adjacent the formation fracture. The method includes activating the polymer patch system to displace polymer toward the formation fracture to isolate the formation fracture, wherein the polymer is or includes a polymer cylindrical layer radially as an outside portion of the polymer patch system.

Yet another aspect relates to a wellbore in a geological formation having a formation fracture at the wellbore. The wellbore includes a casing having a polymer patch system disposed adjacent the formation fracture. The polymer patch system is mechanically activated and includes: a polymer layer displaced against the formation fracture; an internal annulus between the polymer layer and an exterior surface of the casing; an upper elastomer seal; a lower elastomer seal; and an internal support disposed in the internal annulus maintaining the internal annulus between the polymer layer and the exterior surface of the casing.

The details of one or more implementations are set forth in the accompanying drawings and the description below. Other features and advantages will be apparent from the description and drawings, and from the claims.

DETAILED DESCRIPTION

Figure 1:
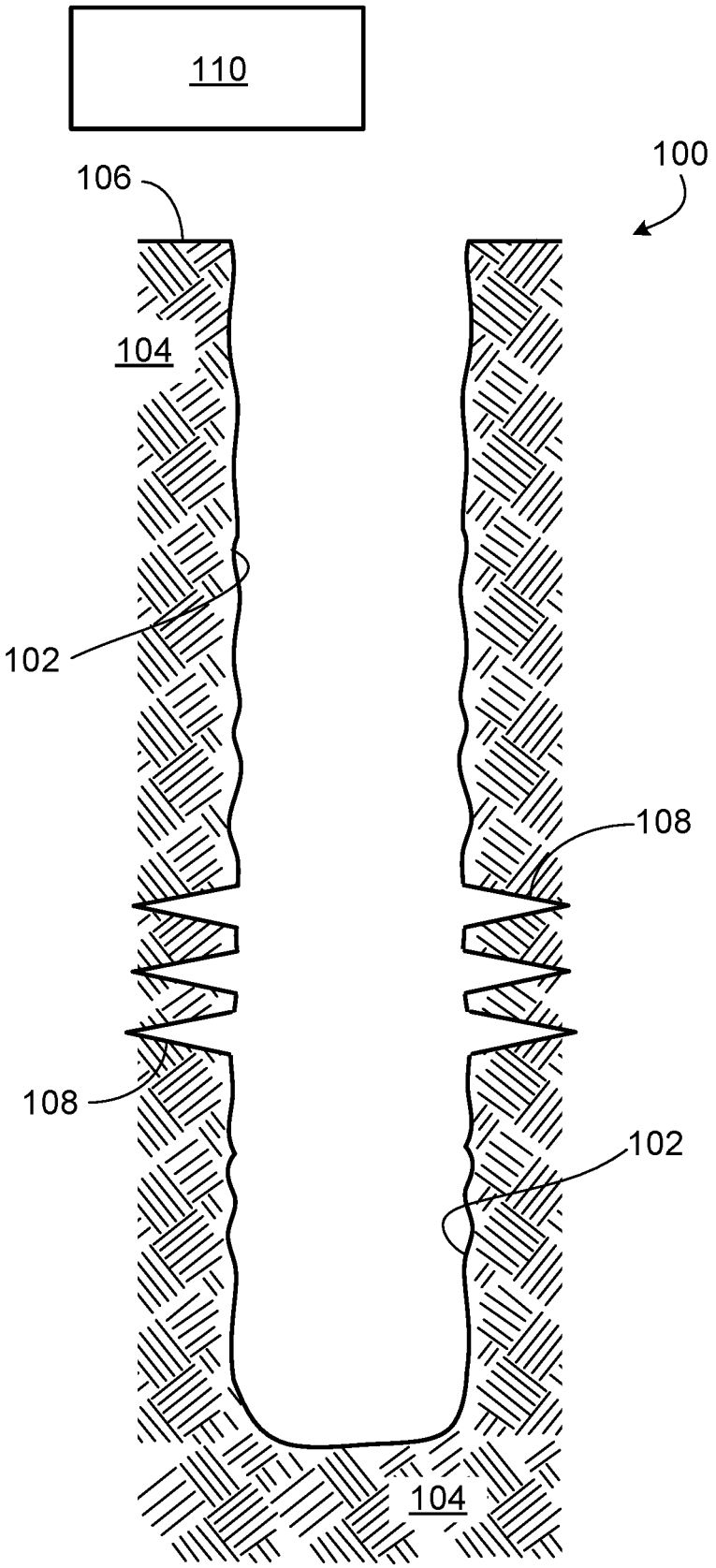
FIG. 1 is a diagram of an open-hole wellbore in an Earth geological formation.

Examples herein seal a loss circulation zone and create a flow path for cement slurry for cementing on the exterior of the casing in the wellbore. Indeed, the present disclosure gives innovative techniques for isolating a loss circulation zone to benefit cementing between the casing and the geological formation. In particular, a loss-circulation zone isolation patch provides a flow path for improved cementing. The technique may facilitate cementing behind the casing (between the casing and the formation) such that the exterior of the casing or work string is not subsequently exposed to formation fluids. Conversely, the casing exterior exposed to formation fluids may face corrosion resulting in casing leaks. However, employment of the present polymer patch may isolate the loss circulation zone and create a flow path behind (outside) the casing for cementing. With a flow path created, a cementing job can be executed with partial or full circulation of the cement slurry to the surface. Activating the loss-circulation polymer patch may promote cementing across the casing-to-formation annulus in which other practices show poor cementing across that area. As discussed below, the patch may be part of a casing with a patch support or arms in the patch interior. In examples, the patch can be activated through dropping a ball into the casing and applying pressure to mechanically activate the polymer patch.

After drilling a hole section, a casing may be ran in hole. In some cases, the hydrocarbon formation adjacent the casing can be fractured. To set the casing in place, a cement may be pumped down through the casing and the cement then flow upward between the casing and the formation. When a loss circulation zone (fracture) is encountered, the fracture may swallow the cement slurry providing poor or weak cementing behind the casing which may result the casing subsequently being exposed to formation fluids. Therefore, examples herein employ a casing polymer patch to seal the fracture and maintain an annulus between the casing and the formation.

Embodiments may be applied to geological formations such as non-cavernous formations. After identifying the loss circulation zone such as a non-cavernous loss circulation zone, a dedicated casing with built-in patch may be ran to the desired depth to the loss circulation zone and set in place. The casing patch may cover most or all of the formation in the zone facilitating isolation at that depth by activating arms of the polymer patch through dropping a ball and applying pressure. This may initiate mechanical activation of the polymer patch to release, displace, or push the polymer against the formation.

The patch may expand to seal above and below the loss circulation zone (LCZ), and provide an annulus between the patch and the casing creating a flow path while sealing the LCZ. Thus, cement may be pumped from the Earth surface down through the casing to the bottom of the casing where the cement flow will exit the casing and turn upward through the annulus between the casing and the patch across the LCZ. The patch will seal the LCZ allowing the cement slurry to pass through the patch annulus (and also through the formation/casing annulus outside of LCZ) to the surface, preventing or reducing the cement from going into the LCZ. Having a good cement behind the casing (between the casing and formation) may prevent formation fluids from corroding the casing which could cause casing leaks. In contrast, a generally unfavorable practice involves leaving the casing exposed to formation fluids.

Thus, as indicated, an objective of implementations herein may include to isolate a loss circulation zone. Benefits may include providing a path for improved cementing of the casing exterior and therefore extending the casing life by not exposing the exterior of the casing to formation water and fluids that may cause corrosion and leaks. In some examples, after cement thickening, the patch may act as an enforcement of cement and may seal if the cement cracks.

A particular embodiment of the present techniques is a casing having polymer on the outer side of the casing to be displaced to seal a formation fracture. In certain examples, arms underneath and attached to the polymer holds the polymer from being displaced until mechanical activation. The polymer may be a component of a polymer patch system dedicated on the casing for application to the formation. A mechanical activator of the polymer patch, such as a sliding pate or sleeve on the inner diameter of the casing, when engaged may release or displace the polymer against the formation. To engage the sliding sleeve such that the polymer patch system is mechanically activated to radially displace the polymer, a dissolvable ball may be dropped through the casing and then pressure applied to the ball to push the sliding sleeve to activate the patch. When the casing is being positioned across the loss zone, the ball may be dropped and will settle at the top of the sliding sleeve in examples. Afterwards, a pressure may be applied on the ball which will cause the sleeve to move downward allowing the polymer to be released from the arms that hold or secure the polymer, or the arms will remain coupled to the polymer and push the polymer against the formation. Furthermore, as discussed below, the polymer patch may provide a path for the cement slurry to pass between the outer diameter (OD) of the casing and the polymer. Without the polymer patch applied to the formation fracture, loss circulation may rob pumped cement into the fracture exposing the casing exterior (including after cementation completion) to formation water which can corrode the casing. Conversely, the aforementioned polymer patch may isolate the fracture and, therefore, the cementation may cover that interval outside the casing adjacent the fracture, preventing or reducing formation fluids from entering through the fracture and contacting the casing. Lastly, where feasible during drilling, certain instances of the techniques may reduce loss circulation of drilling fluid or other fluids.

FIG. 1 is a wellbore 100 having a wall 102 formed in a geological formation 104. The wellbore 100 is drilled through the Earth surface 106 into the Earth crust having the geological formation 104. The geological formation 104 may have hydrocarbons such as crude oil and natural gas. In the illustrated example, the wellbore 100 has undesirable fractures 108 giving a lost circulation zone, as discussed below.

A borehole or wellbore 100 may be drilled into a geological formation 104 or hydrocarbon reservoir in the Earth for the exploration or production of oil and gas. Indeed, oil and natural gas drilling rigs create holes to identify geologic reservoirs and that allow for the extraction of oil or natural gas from those reservoirs.

Surface equipment 110 may be associated with the wellbore 100 for drilling the wellbore 100 and the subsequent installation of casing into the wellbore 100, and for cementing the annulus between the casing (not shown) and the wall 102 of the wellbore 100. The surface equipment 110 may include a mounted drilling rig which may be a machine that creates boreholes in the Earth subsurface. The term "rig" may refer to equipment employed to penetrate the Earth surface 106 of Earth crust. To form a hole in the ground, a drill string having a drill bit may be lowered into the hole being drilled. In operation, the drill bit may rotate to break the rock formations to form the hole as a borehole or wellbore 100. In the rotation, the drill bit may interface with the ground or formation 104 to grind, cut, scrape, shear, crush, or fracture rock to drill the hole. The open-hole wellbore 100 having a wall 102 with the formation 104 as depicted in FIG. 1 is drilled and formed through the Earth surface 106 into the hydrocarbon formation.

In operation, a drilling fluid (also known as drilling mud) is circulated down the drill string to the bottom of the wellbore 104. The drilling fluid may then flow upward toward the surface through an annulus formed between the drill string (not shown) and the wall 102 of the wellbore 100. The drilling fluid may cool the drill bit, apply hydrostatic pressure upon the formation penetrated by the wellbore, and carry formation cuttings to the surface, and so forth. In addition to the drilling rig, surface equipment 110 may include tanks, separators, pits, pumps, and piping for circulating drilling fluid (mud) through the wellbore.

A casing may be lowered into the wellbore 100 and cement slurry applied to the annulus between the casing and the wall 102 of the wellbore 100. Oil well cementing may include mixing a slurry of cement and water, and pumping the slurry down the wellbore 100 casing, tubing, or drill pipe to a specified elevation or volume in the well. Primary cementing may involve casing cementation. In particular, primary cementing may be the cementing that takes place soon after the lowering of the casing into the formation 104 and may involve filling the annulus between the casing and the formation 104 with cement.

As mentioned, in the illustrated example of FIG. 1, the wellbore 100 has fractures 108 through the wellbore wall 102 into the geological formation 104. These fractures 108 may result in a loss circulation zone of the wellbore 100. A loss circulation zone, also known as a thief zone, is a zone in which drilling fluid (drilling mud) or cement slurry enters the geological formation 104 from the borehole or wellbore 100. In a loss circulation zone, the drilling fluid circulating through the wellbore 100 during drilling operations or the cement slurry applied in cementing operations may unfortunately exit the wellbore 100 through the fractures 108 into the geological formation 104. Such may result in loss circulation or partial loss circulation of the drilling fluid or cement slurry.

The loss of cement slurry due to the loss circulation zone fractures may give inadequate cementation between the casing and the formation. Thus, after this insufficient cementation is completed (including during the subsequent production of hydrocarbons), formation water may unfortunately enter through the fractures 108 of the loss circulation zone to the exterior of the casing and corrode the casing.

As discussed herein, a casing having a polymer patch that applies a polymer layer to seal a formation fracture is deployed. Such may prevent or reduce loss circulation that would occur due to the fracture 108. The casing (not shown) having the built-in patch is ran in hole to adjacent the fracture 108. The patch is mechanically activated, such as via dropping a ball into the casing and/or applying pressure, to displace the polymer against the formation 104 fracture 108. The patch has a cavity to provide for an annulus in loss circulation zone for cement to flow without loss circulation, and the cement slurry then proceed out of the zone into the annulus between the casing and the formation as is typical.

Figure 2:
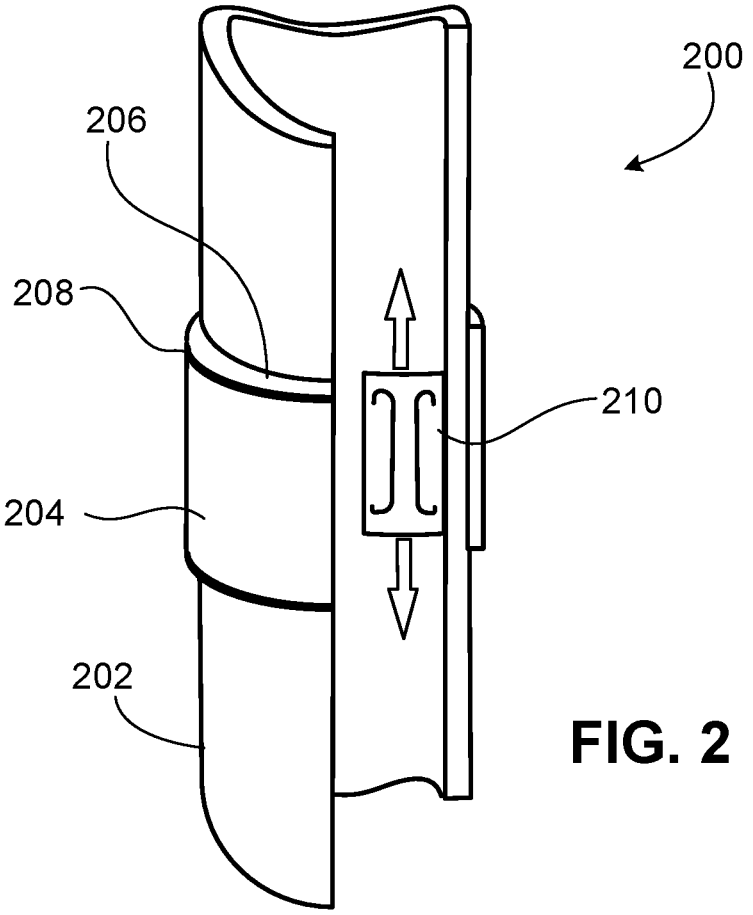
FIG. 2 is a partial view of a casing having a polymer patch for deployment in a loss circulation zone.

FIG. 2 is a partial view of a casing 200 to be lowered into a wellbore such as into the wellbore 100 of FIG. 1. The casing 200 has a cylindrical wall 202 as is typical. The casing 200 has a polymer patch 204 to be mechanically activated. At least a portion of the polymer patch 204 system may be disposed on the outer diameter (OD) of the casing wall 202. The casing polymer patch 204 includes a polymer to patch, seal, or isolate formation fractures at the wellbore wall, such as the formation fractures 108 at the wellbore wall 102 of FIG. 1. The casing polymer patch 204 as depicted in FIG. 2 is non-activated.

The casing polymer patch 204 may be characterized as having polymer (exterior layer), internal annulus 206 (collapsed before activation), elastomer seals 208, internal supports such as arms in the annulus 206, a mechanical trigger 210 (on the casing 200 inner diameter) for activation, and so on. In the non-activated state depicted, the internal annulus 206 (between the polymer and the casing 200) is generally not a full/expanded annulus for flow but instead is in a collapsed state which can be characterized as a pre-annulus. In response to activation of the polymer patch 204, the annulus 206 will expand to a full annulus state with the displacing of the polymer against the formation creating a patch of the formation fractures. The elastomer seals 208 at the top and bottom of the polymer may further facilitate sealing of the loss zone to prevent or reduce leaking of cement slurry (between the positioned polymer and the formation) into the fracture of the loss zone.

In the non-activated state of the casing polymer patch 124 as depicted in FIG. 2, the external surface of exterior polymer layer of the patch 204 may be exposed such that when the polymer patch 124 is mechanically activated, the polymer may readily expand or be pushed to engage the formation 104. The polymer itself may be the covering of the casing polymer patch 204 and be released or displaced to form a cylindrical annulus (internal annulus 206) radially around the casing 200. Examples of the polymer include polysulfone, polyetherimide any high performance thermoplastics like polyetherketone (PEK), polyimide-imides (PAI), polyphenylsulfone (PPSU), and the like.

After activation of the polymer patch 204, the polymer may reside against the formation 104 isolating the fractures 108 from the casing and wellbore. The isolation of the fractures 108 via the polymer may prevent or reduce flow of fluid or cement slurry (such as during primary cementing) into the geological formation 104 through the fractures 108. Such may be characterized as isolating a loss circulation zone. In one example, the patch 124 is at least 20 feet in height and the casing 200 joint is at least 30 feet in length, and with the loss circulation zone at least 5 feet in height. Thus, in application, the patch covers at least 5-10 feet below and 5-10 feet above the loss circulation zone, and can account for an error in identification of the loss circulation zone of at least 1-2 feet. Of course, other lengths and dimensions may be accommodated.

As indicated, the polymer patch 204 system includes an internal annulus 206 and seals 208. As discussed, the annulus 206 may be between the polymer and the outer surface of the cylindrical wall 202 of the casing 200. The seal 208 may be an elastomer or rubber seal.

The casing 200 includes a mechanical trigger or activator 210 to activate the polymer patch 204 to expand or push the polymer of the polymer patch 204 against the formation 104 and the fractures 108. In examples, arms in the polymer patch 204 push or displace the polymer upon mechanical activation of the polymer patch 204. In one example, the polymer is a semi-rigid cylindrical sheet of polymer that is displaced radially and pressed against the formation 104 when the casing polymer patch is mechanically activated.

In the illustrated example of FIG. 2, the mechanical activator 210 is a sliding plate or sleeve on an inside diameter (ID) surface of the cylindrical portion 202 of the casing 200. The sliding sleeve 210 may be triggered, for example, by dropping an activation ball into the casing 200 to engage the sliding plate or sleeve. Pressure may be applied via, for example, drilling fluid through the casing to push the activation ball across the sliding sleeve. The ball may be dissolvable and allowed to dissolve in the wellbore over time.

In summary, the polymer patch 204 system may have a mechanical trigger 210 when engaged to activate the polymer patch 204 system to release the polymer layer against the geological formation 104 in the wellbore 100. In examples, the mechanical trigger is a sliding sleeve or plate to be disposed on an internal diameter (ID) of the casing 200 and to be engaged by an activation ball dropped into the casing. Of course, other types or configurations of a mechanical activator 210 can be employed.

In all, the trigger or activator 210 when engaged and implemented provides for activation of the polymer patch 204 in mechanically deploying the polymer against the formation 104 at the undesirable fractures 108. Before activation, the polymer may be held by internal supports or arms and/or compressed against the casing 200. Upon activation of the polymer patch 204, the polymer layer may expand outward. In examples, the polymer is somewhat rigid when expanded and rests (or is pressed) against the formation 104 to isolate the fractures 108. In certain examples, the polymer does not enter the fractures 108, or does not significantly enter the fractures 108. The polymer may be semi-rigid without need to harden. In one implementation, the activation in addition to mechanically releasing the polymer against the formation 104 may also additionally include a chemical activation of the polymer.

Figure 3:
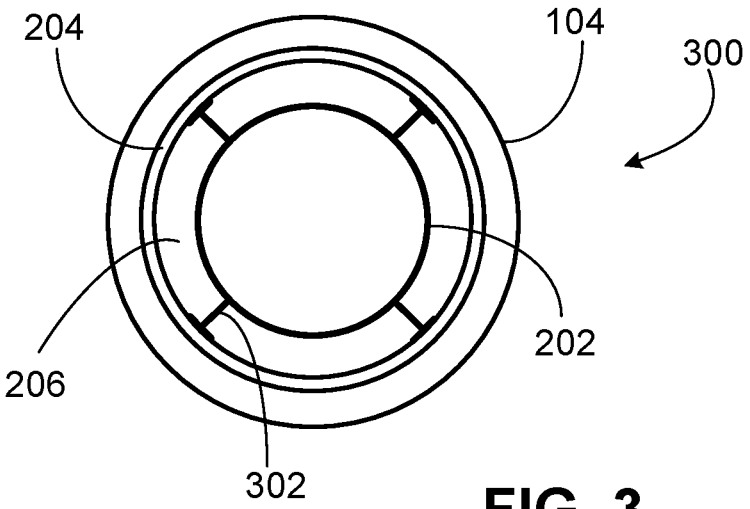
FIG. 3 is a top full view of the casing of FIG. 2 deployed in a loss circulation zone in a wellbore with the polymer patch mechanically activated.

FIG. 3 is a top view of a casing 300 having the polymer patch 204 as activated. The casing 300 may be the casing 200 (having the non-activated polymer patch 204) depicted in the partial view of FIG. 2 but with the polymer patch 204 activated mechanically in FIG. 3. As discussed, the polymer patch 204 may be activated mechanically, such as via the sliding sleeve 210 of FIG. 2, to deploy the polymer of the polymer patch 204 against the geological formation 104. With the polymer so implemented, the polymer may seal or isolate the fractures 108 (see FIG. 1) and thus isolate the lost circulation zone resulting from the fractures 108. In one example with the patch 204 activated, the polymer is a cylinder of the polymer that rests, and/or is pressed, against the formation 104 having the fractures 108.

As also discussed, the polymer patch 204 provides for an annulus 206 between the polymer layer (at the formation 104) and the outer surface of the cylindrical wall 202 of the casing 200. In some examples, the polymer patch 204 may include supports 302, such as arms, plates, beams, or channels, to maintain the annulus 206. The supports 302 may push the patch 204 polymer against the formation 104. On the other hand, the supports 302 may release the polymer upon mechanical activation but also prevent the polymer from substantially collapsing the annulus 206. Again the patch 204 polymer may be a cylindrical layer in certain examples. The supports 302 may engage the polymer directly. Moreover, in the mechanical activation of the casing polymer patch 204 via engagement of the sliding sleeve 210, the supports or arms 302, or other internal components such as expanders, may extend to deploy the polymer layer against the formation 104. In examples, the arms 302 may generally stay in contact with the polymer. Other configurations are applicable.

Figure 4:
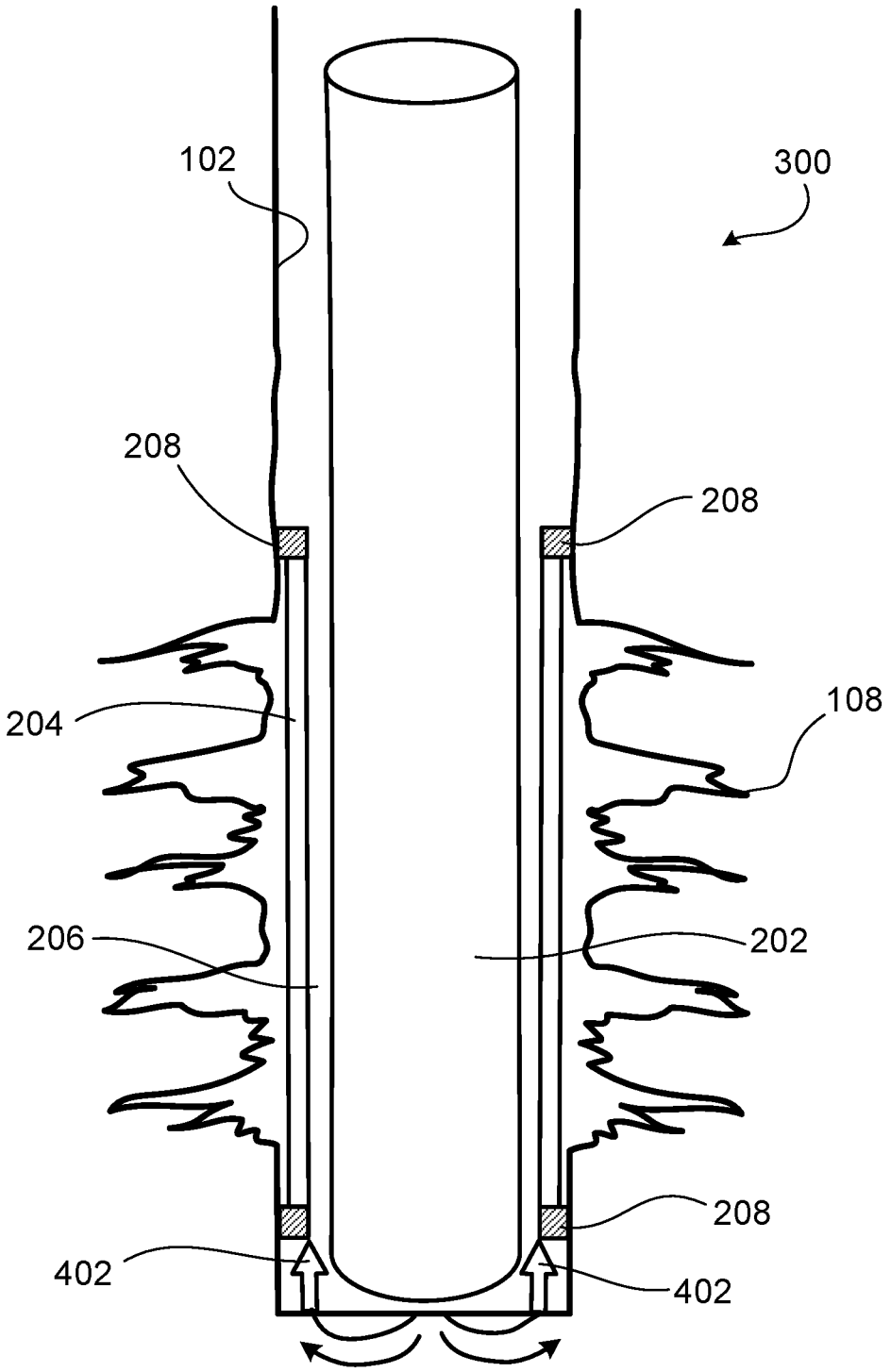
FIG. 4 is a side view of the wellbore of FIG. 3 having the casing with the activated polymer patch applied against the geological formation.

FIG. 4 is a side view of the casing 300 installed in the wellbore 100. The polymer patch 204 is activated and implemented against the formation 104 at the borehole wall 102. The deployed polymer layer of the polymer patch 204 may run vertically along the fractures 108 from the lower elastomer seal 208 to the upper elastomer seal 208. Therefore, the fractures 108 are isolated from the casing 300 exterior wall and the cased wellbore 100 cavity. The polymer patch 204 provides the annulus 206 for the flow of fluids or cement slurry. Thus, the fluid or cement slurry that may discharge from the bottom of the casing 300 may flow upward, as indicated by arrows 402, through the annulus 206 toward the Earth surface.

The patch 204 polymer may be kept in place against the formation 104 via the arms 302 (see FIGS. 3 and 7) or other supports, or the arms 302 may prevent the patch 204 polymer from collapsing the patch annulus 206. The elastomer or rubber seals 208 may aid sealing and isolating the outer annulus between the patch 124 polymer and the formation 104, preventing flowing cement slurry 402 from passing behind or outside the patch 124 polymer into the fracture 108. Instead, the cement slurry will flow through the patch 124 annulus 206, as configured and desired. Therefore, in summary, the polymer patch 124 system may have elastomer or rubber seals 108 to facilitate adequate isolation of the fractures 108. The rubber seals 208 may promote that flowing cement 402 is routed through the patch annulus 206 and not into any outer annulus between the polymer and the fractures 108, and therefore not into the fractures 108.

As depicted in the illustrated example, the upper elastomer seal 208 is disposed axially adjacent an upper portion of the polymer layer and an upper portion of the internal annulus 206, and the lower elastomer seal 208 is disposed axially adjacent a lower portion of the polymer layer and a lower portion of the internal annulus 206. As indicated, the internal annulus 206 may route a cement slurry for cementation (for example, primary cementation), and wherein the upper elastomer seal 208 and the lower elastomer seal 208 do not block the flow path through the internal annulus 206.

In summary, an embodiment is a casing 200 for a wellbore 100. The casing 200 has a polymer patch disposed on an outer diameter (OD) of the casing wall 202 to be mechanically activated to release polymer against a formation fracture 108 in a loss circulation zone of the wellbore 100. The polymer patch includes the polymer to be released to isolate the formation fracture 108 and a patch annulus 206 to route a flowing cement slurry for cementation. In addition, the polymer patch 204 may have elastomer seals 208 to isolate the formation fracture 108. In examples, the elastomer seals 208 include a lower seal 208 to facilitate routing of the flowing cement slurry through the patch annulus, the lower seal 208 to be positioned vertically further downhole below the formation fracture 108. In some examples, the elastomer seals 208 include an upper seal 208 to be positioned vertically above the formation fracture 108 toward the Earth surface. Furthermore, the casing may include a sliding sleeve disposed on an inner diameter (ID) of the casing to mechanically activate the polymer patch 204. In a particular example, the polymer is a polymer layer to be dispose vertically along the wellbore wall 102 at the formation fracture 108. Lastly, in certain implementations, during subsequent production, production fluid including hydrocarbon from the formation 104 may flow upward through interior of the casing 300 to the surface.

Figure 5:
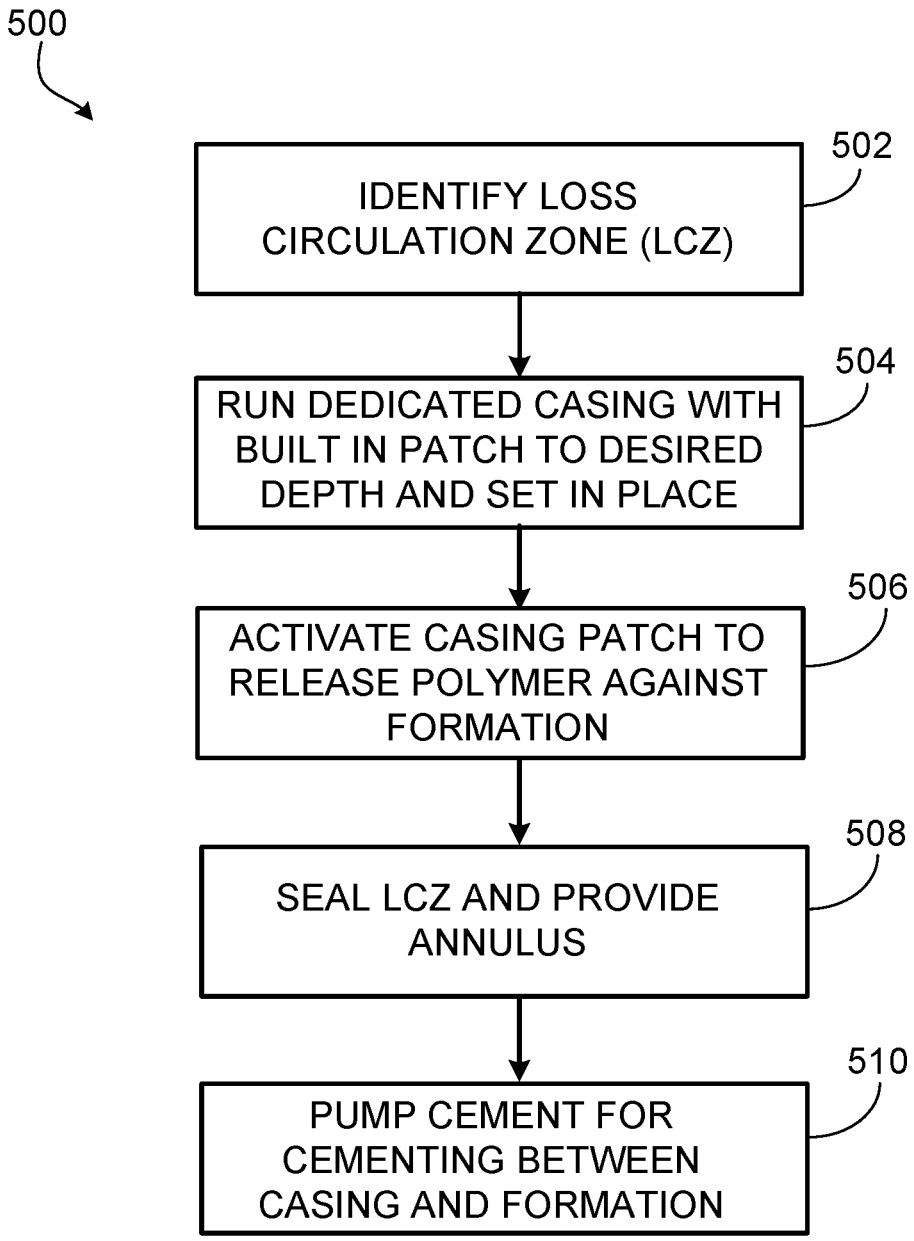
FIG. 5 is a block flow diagram of a method of isolating a formation fracture in a loss circulation zone in a wellbore.

FIG. 5 is a method 500 of isolating a loss circulation zone (LCZ). Such may promote adequate cementation on the outside of a casing and prevent formation fluids such as water entering through formation fractures and contacting the exterior of the casing. At block 502, the method includes identifying an LCZ in a borehole or open-hole wellbore, or open-hole portion of a wellbore. As discussed, an LCZ may be caused by fractures in the geological formation at the borehole. In examples, the geological formation is a non-cavernous formation.

At block 504, the method includes running a dedicated casing with a built-in polymer patch to the desired depth at an LCZ in the wellbore. The dedicated casing may be lowered into the wellbore via a drilling rig, work string, and the like. Again, the LCZ may be the result of fractures in the geological formation at the wall of the wellbore. The dedicated casing may be set in place adjacent the fractures. The casing may be dedicated in the sense that the particular segment of casing has the built-in polymer patch for an LCZ. The polymer patch may have an outer radial polymer layer that is held in place via internal supports such as arms attached to the interior surface of the cylindrical polymer layer.

At block 506, the method includes mechanically activating the casing polymer patch to displace the polymer against the formation. The casing or polymer patch system may have a mechanical activator to trigger to activate displacing of the polymer from the casing patch. In examples, the displacing of the polymer radially may be facilitated by extending of the aforementioned internal supports.

In one implementation, the mechanical activator includes a sliding sleeve or plate on an inside diameter (ID) of the casing 200 or casing wall 202 (see for example, FIG. 2). The sliding sleeve may be engaged, for example, by dropping an activation ball into the casing 200 to push the sliding sleeve. Pressure may be applied through the casing to push the activation ball across the sliding sleeve. In some examples, the activation ball is dissolvable.

Engagement of the mechanical activator may alter the operating position of the securing devices (for example, the internal support or arms) to displace the polymer from the polymer patch toward the formation. In examples, the polymer layer is an outer layer of the non-activated casing polymer patch and thus the exterior of the polymer layer is exposed. Thus, when the polymer patch is mechanically activated, the polymer can readily deploy to the formation. In all, the mechanical activator (for example, sliding sleeve or plate) when engaged may initiate radial displacement of the polymer from the casing polymer patch system. Again, in one example, engagement of the sliding sleeve causes securing devices to radially expand the polymer layer.

At block 508, the polymer pushed radially toward the geological formation from the casing polymer patch system isolates the formation fractures at the borehole and thus seals that LCZ. As discussed above, the casing polymer patch has an annulus to provide for fluid flow or cement slurry flow between the isolated fractures and the exterior of the casing. The polymer patch system may also have elastomer or rubber seals to facilitate adequate isolation of the fractures. Moreover, the rubber seals may promote that flowing cement is routed through the patch annulus and not into the outer annulus between the polymer and the fractures, and therefore not into the fractures.

As for displacement of the polymer against the formation 104 to isolate the fractures 108, different types of polymers or polymer systems may be employed. Depending on the polymer and the application, the polymer when applied may go partially into the fractures 108 to plug the fracture 108, or instead merely reside against the formation 104 isolating the fractures 108 from the casing and wellbore, or a combination thereof. In one example, the polymer is somewhat rigid when released and rests, or is pressed, against the formation 104 to isolate the fractures 108 and may not readily enter the fractures 108. In another example, the released polymer is partially deformable against or into an entry portion of the fractures 108. In one example, the polymer hardens. However, in the illustrated embodiment of FIG. 4, the polymer layer is semi-rigid and does not readily flow into the fractures 108. Other configurations are applicable.

At block 510, after isolation of the loss circulation fractures is complete, the method includes pumping cement slurry between the casing and formation for cementation on the external side of the casing. In the cementation, the cement slurry flows through the patch annulus so that the formation fractures do not rob flow of cement.

An embodiment is a method of isolating a formation fracture in a loss circulation zone in a wellbore. The method includes lowering a casing having a polymer patch system into the wellbore to adjacent the formation fracture. The method includes activating the polymer patch system to release or displace polymer from the polymer patch system to isolate the formation fracture. The activating may involve dropping a ball into the casing to mechanically activate the polymer patch system. The activating may involve engaging a sliding sleeve on an internal diameter of the casing to mechanically activate the polymer patch system. In examples, the method includes deploying a first elastomer seal at an upper portion of the polymer and a second elastomer seal at a lower portion of the polymer. The method may also include supporting the polymer with arms in the polymer patch system. Moreover, the polymer may be a polymer cylindrical layer radially as an outside portion of the polymer patch system. In certain implementations, the method include flowing a cement slurry through an internal annulus of the polymer patch system for cementing the casing. In some examples, the method include flowing production fluid including hydrocarbon through the casing.

Figure 6:
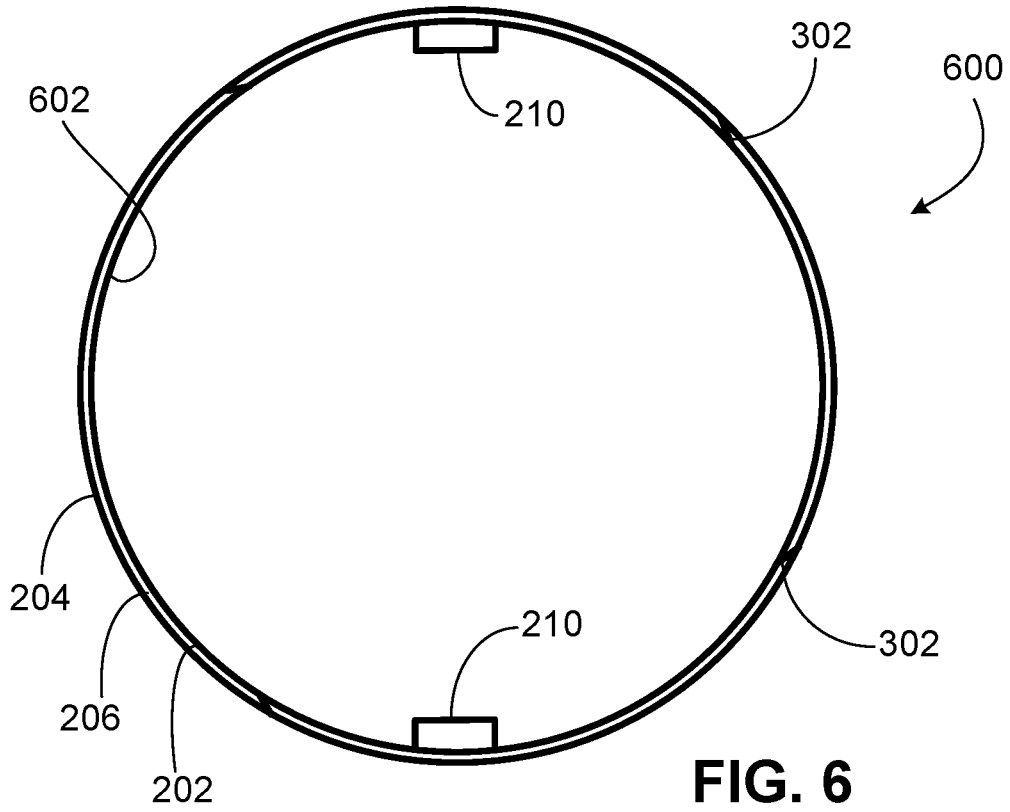
FIG. 6 is a diagram of a top view of a casing having a polymer patch for a wellbore and with the polymer patch not activated.
Figure 7:
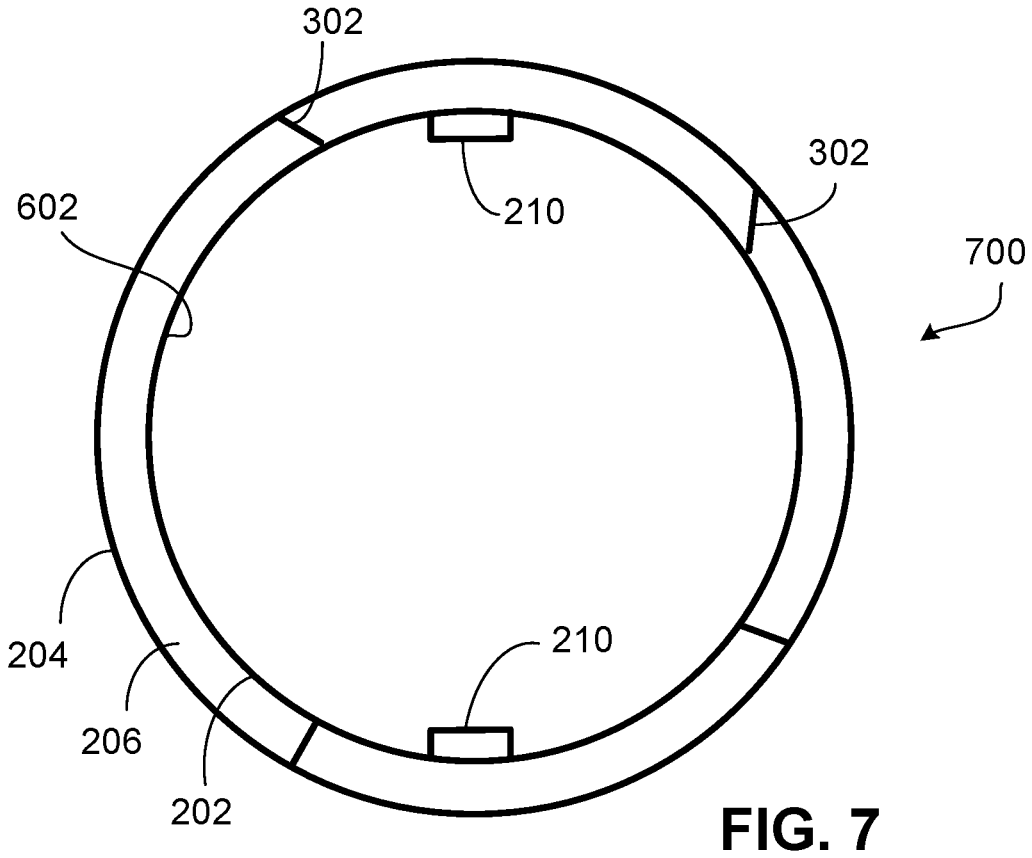
FIG. 7 is a diagram of a top view of the casing of FIG. 6 but with the casing polymer patch activated.

FIG. 6 and FIG. 7 are a top view of a casing 600 having an inside surface 602 (inner diameter) defining a cylindrical cavity for the flow of fluids including production fluids such as oil and gas. Indeed, the casing 600 is for a wellbore in a geological hydrocarbon formation.

The casing 600 has a polymer patch 204 for patching fractures in a geological formation to isolate a loss circulation zone in the wellbore. The polymer patch 204 in FIG. 6 is depicted as not mechanically activated. Conversely, the polymer patch 204 in FIG. 7 is depicted as mechanically activated.

A polymer layer is the outer portion of the polymer patch 204. Further, the polymer patch 204 has internal supports 302, such as arms, that hold the polymer layer. The outer polymer layer and internal supports 302 are disposed on an outer diameter of the casing 600. The supports 302 may be coupled to the polymer layer and the casing 600, such as via hooks, clamps, adhesive, bolts, screws, and so forth.

The polymer patch 204 has one or more mechanical triggers 210 disposed on the inner diameter of the casing 600 for mechanically activating the polymer patch 204. The mechanical triggers 210 when engaged, as discussed above with respect to the preceding figures, may activate the polymer patch 204. Such activation may be similar to the setting of a packer, bridge plug, cement retainer, and the like. Mechanisms and structural features of the casing 600 and its polymer patch 204, such as an expansion sleeve, mandrel, setting tool, and so on, may position the supports 302 to expand the polymer. In the activation, the supports 302 move or extend to radially displace the polymer outer layer of the polymer patch 204 away from the casing 300. The supports 302 may have hinges or may rotate, or be otherwise configured, to extend, expand, or push the polymer layer radially outward.

The polymer patch 204 has an internal annulus 206 between the polymer layer and the exterior surface of the casing 600. In FIG. 6, the internal annulus 206 is collapsed (a pre-annulus) with the polymer layer on or near the casing 600 exterior cylindrical-wall surface, and with the internal supports 302 in a contracted or non-activated state. In FIG. 7, the internal annulus 206 is expanded and formed with the internal supports 302 moved to push the polymer layer outward. The patch annulus 206 may receive cement slurry for routing the cement slurry through the annulus 206, and with the cement slurry discharging from the annulus 206 upward toward the surface. Such flow of cement slurry may be performed, for example, in primary cementation between the formation and the casing.

The polymer patch 204 also has upper and lower elastomer seals (not shown), as discussed above. See, for examples, seals 208 in FIG. 4. The seals may contribute to isolation of the formation fracture. Indeed, the expanded cylindrical polymer layer along with the upper seal and lower seal (see, for example, FIG. 4) may isolate the loss circulation zone. The isolation may prevent cement slurry from exiting into the formation fracture and thus facilitate adequate cementing of the casing. Therefore, formation fluids may be prevented from reaching the exterior of the casing through the formation fracture.

In summary, an embodiment is a polymer patch system to be disposed built-in on a casing for a wellbore or borehole. The polymer patch system has a polymer layer, an upper elastomer seal, and a lower elastomer seal. The polymer patch system has an internal space radially under the polymer layer to form an internal annulus between the polymer layer and an exterior surface of the casing. An internal support is disposed in the internal space to maintain the internal annulus between the polymer layer and the casing. At least a portion of the polymer patch system may be disposed on an outer diameter (OD) of the casing and with the internal annulus as collapsed, and wherein the internal support to expand the internal annulus upon mechanical activation of the polymer patch system. In some examples, the upper elastomer seal is disposed axially adjacent an upper portion of the polymer layer and an upper portion of the internal space, wherein the lower elastomer seal is disposed axially adjacent a lower portion of the polymer layer and a lower portion of the internal space, and wherein the internal support to displace the polymer layer radially upon mechanical activation of the polymer patch system. In certain implementations, the internal annulus as expanded after mechanical activation of the polymer patch system to route a cement slurry for cementation, and wherein the upper elastomer seal and the lower elastomer seal do not block a flow path through the internal annulus. The polymer patch system can include a mechanical trigger when engaged to activate the polymer patch system to radially displace the polymer layer against a geological formation in a wellbore. In a particular example, the mechanical trigger includes a sliding sleeve or plate to be disposed on an internal diameter (ID) of the casing and to be engaged by an activation ball dropped into the casing.

Another embodiment is a casing for a wellbore. The casing has a polymer patch disposed on an outer diameter (OD) of the casing and to be mechanically activated to radially displace polymer against a formation fracture in a loss circulation zone of the wellbore. The polymer patch has the polymer to be radially displaced to isolate the formation fracture, elastomer seals to isolate the formation fracture, a patch annulus to be expanded to route a flowing cement slurry for cementation, and an internal support disposed in the patch annulus. The polymer may be a polymer layer to be disposed along the wellbore wall at the formation fracture. In examples, the patch annulus is collapsed prior to mechanical activation of the patch, and wherein the internal support to expand the patch annulus in response to mechanical activation of the polymer patch. In some examples, the elastomer seals include a lower seal to be positioned vertically downhole below the formation fracture, the lower seal to facilitate routing of the flowing cement slurry through the patch annulus as expanded in response to mechanical activation of the polymer patch. In implementations, the elastomer seals include an upper seal to be positioned vertically above the formation fracture toward an Earth surface. The casing may have a sliding sleeve disposed on an inner diameter (ID) of the casing to mechanically activate the polymer patch.

Yet another embodiment is a method of isolating a formation fracture in a loss circulation zone in a wellbore, including lowering a casing having a polymer patch system into the wellbore to adjacent the formation fracture. The method includes activating the polymer patch system to displace polymer toward the formation fracture to isolate the formation fracture, wherein the polymer is or includes a polymer cylindrical layer radially as an outside portion of the polymer patch system. The activating may involve dropping a ball into the casing to mechanically activate the polymer patch system. The activating may involve engaging a sliding sleeve on an internal diameter of the casing to mechanically activate the polymer patch system. The method may include deploying a first elastomer seal at an upper portion of the polymer and a second elastomer seal at a lower portion of the polymer, wherein the polymer patch system comprises the first elastomer seal and the second elastomer seal. In addition, the method may include supporting the polymer with arms in the polymer patch system. In some examples, the method includes flowing a cement slurry through an internal annulus of the polymer patch system for cementing the casing. The method may include flowing production fluid including hydrocarbon through the casing.

Yet another embodiment is a wellbore in a geological formation having a formation fracture at the wellbore. The wellbore includes a casing having a polymer patch system disposed adjacent the formation fracture. The polymer patch system is mechanically activated and includes: a polymer layer displaced against the formation fracture; an internal annulus between the polymer layer and an exterior surface of the casing; an upper elastomer seal; a lower elastomer seal; and an internal support disposed in the internal annulus maintaining the internal annulus between the polymer layer and the exterior surface of the casing. In certain examples, at least a portion of the polymer patch system is disposed on an outer diameter (OD) of the casing. In some implementations, the upper elastomer seal is disposed axially adjacent an upper portion of the polymer layer and an upper portion of the internal annulus, and wherein the lower elastomer seal is disposed axially adjacent a lower portion of the polymer layer and a lower portion of the internal annulus. The internal annulus may be for routing a cement slurry for cementation, and wherein the upper elastomer seal and the lower elastomer seal generally do not block a flow path through the internal annulus in some examples. In certain implementations, the polymer patch system or the casing has a mechanical trigger when engaged activates the polymer patch system to displace the polymer layer against the formation fracture. In particular examples, the mechanical trigger includes a sliding sleeve or plate disposed on an internal diameter (ID) of the casing and configured to be engaged by an activation ball dropped into the casing.

A number of implementations have been described. Nevertheless, it will be understood that various modifications may be made without departing from the spirit and scope of the disclosure.

What is claimed is:

1. A polymer patch system comprising:

a polymer patch system to be disposed built-in on a casing configured to be cemented in a wellbore, the polymer patch system comprising:

a polymer layer configured to be disposed to isolate a loss circulation zone in the wellbore by sealing a formation fracture in a geological formation at a wall of the wellbore, the polymer layer configured to be in an unexpanded state when the polymer patch system is in a non-activated state when the casing is lowered into a wellbore, the polymer layer configured to transition to an expanded state when the polymer patch system is transitioned to an activated state, wherein, in the expanded state, the polymer layer is configured to be applied against the geological formation to seal the formation fracture to isolate the loss circulation zone;

an internal space radially under the polymer layer to form an internal annulus between the polymer layer and an exterior surface of the casing for flow of fluid through the internal annulus;

an upper elastomer seal disposed at an uphole end of the polymer patch system;

a lower elastomer seal disposed at a downhole end of the polymer patch system, the polymer layer running from the upper elastomer seal to the lower elastomer seal, the upper elastomer seal and the lower elastomer seal configured to prevent fluid flow into the formation fracture through the uphole end and the downhole end, respectively, when the polymer patch system is in the activated state; and a plurality of internal supports disposed in the internal space to maintain the internal annulus between the polymer layer and the casing, wherein when the polymer patch system is in the activated state, the polymer layer, the upper elastomer seal, and the lower elastomer seal are configured to prevent fluid flow into the geological formation through the formation fracture from the wellbore.

2. The polymer patch system of claim 1, wherein at least a portion of the polymer patch system to be disposed on an outer diameter (OD) of the casing, and wherein the plurality of internal supports are configured to extend from the non-activated state to the activated state upon mechanical activation of the polymer patch system.

3. The polymer patch system of claim 1, wherein the upper elastomer seal is disposed axially adjacent an upper portion of the polymer layer and an upper portion of the internal space, wherein the lower elastomer seal is disposed axially adjacent a lower portion of the polymer layer and a lower portion of the internal space, and wherein the plurality of internal supports are configured to at least one of support or displace the polymer layer radially upon mechanical activation of the polymer patch system.

4. The polymer patch system of claim 3, wherein fluid to be flowed through the internal annulus when the polymer patch system is in the activated state comprises a cement slurry for primary cementation of the casing, and wherein the upper elastomer seal and the lower elastomer seal do not block a flow path of the cement slurry through the internal annulus when the polymer patch system is in the activated state.

5. The polymer patch system of claim 1, comprising a mechanical trigger, which when engaged is configured to activate the polymer patch system to radially displace the polymer layer against the geological formation at the formation fracture at the wall of the wellbore.

6. The casing of claim 5, wherein the mechanical trigger comprises a sliding sleeve or plate configured to be disposed on an internal diameter (ID) of the casing and configured to be engaged by an activation ball dropped into the casing, wherein each internal support of the plurality of internal supports having an end attached to the polymer layer, each internal support extendable from the non-activated state to the activated state to transition the polymer layer from the unexpanded state to the expanded state, wherein, when the polymer patch system is in the activated state, the plurality of internal supports maintain the internal annulus between the polymer layer and an exterior surface of the casing, and wherein the internal annulus is configured to permit the flow of the cement slurry through the internal annulus while avoiding the loss circulation zone.

7. A casing for a wellbore formed in a geological formation, the casing comprising:

a casing to be cemented in the wellbore with cement on an exterior surface of the casing in an annulus between the casing and the geological formation, wherein the casing comprises a polymer patch disposed on an outer diameter (OD) of the casing and to be mechanically activated to radially displace polymer against the geological formation comprising a formation fracture in a loss circulation zone of the wellbore, the polymer patch comprising:

the polymer configured to be radially displaced against the geological formation at the formation fracture to seal the formation fracture to isolate the loss circulation zone, wherein the geological formation defines a wellbore wall of the wellbore at the loss circulation zone prior to cementing of the casing;

elastomer seals attached to ends of the polymer, the elastomer seals configured to isolate the formation fracture from fluid flow through the ends of the polymer, wherein the polymer layer and the elastomer seals are configured to prevent fluid flow into the geological formation through the formation fracture from the wellbore;

a patch annulus configured to be expanded to route a flowing cement slurry for cementation while avoiding the formation fracture in the loss circulation zone; and an internal support disposed in the patch annulus.

8. The casing of claim 7, wherein the patch annulus is collapsed prior to mechanical activation of the patch, and wherein the internal support is configured to radially expand the polymer against the geological formation and radially expand the patch annulus in response to mechanical activation of the polymer patch.

9. The casing of claim 7, wherein the elastomer seals comprise a lower seal to be positioned vertically downhole below the formation fracture, the lower seal configured to facilitate routing of the flowing cement slurry through the patch annulus as expanded in response to mechanical activation of the polymer patch.

10. The casing of claim 8, wherein the elastomer seals comprise an upper seal to be positioned vertically above the formation fracture toward an Earth surface.

11. The casing of claim 7, comprising a sliding sleeve disposed on an inner diameter (ID) of the casing to mechanically activate the polymer patch.

12. The casing of claim 7, wherein the polymer comprises a polymer layer to be disposed along the wellbore wall comprising the geological formation at the formation fracture after activation of the polymer patch.

13. A method of isolating a formation fracture in a loss circulation zone in a wellbore, comprising:

lowering a casing having a polymer patch system on an outer diameter of the casing into the wellbore adjacent the formation fracture in the loss circulation zone, wherein the polymer patch system comprises a polymer configured to seal the formation fracture to fluid flow at the loss circulation zone and an internal support in an annulus between the patch system and the casing; and activating the polymer patch system to cause the internal support to expand the polymer against the formation fracture; and after contacting the formation fracture with the polymer, sealing ends of the polymer to seal isolate the formation fracture to fluid flow at the loss circulation zone while allowing flow through the annulus, wherein the polymer comprises a polymer cylindrical layer radially as an outside portion of the polymer patch system.

14. The method of claim 13, wherein activating comprises dropping a ball into the casing to mechanically activate the polymer patch system.

15. The method of claim 13, wherein activating comprises engaging a sliding sleeve on an internal diameter of the casing to mechanically activate the polymer patch system.

16. The method of claim 13, wherein sealing the ends of the polymer to seal the formation fracture to fluid flow into the loss circulation zone comprises a first elastomer seal at an upper end of the polymer and a second elastomer seal at a lower end of the polymer, wherein the polymer patch system comprises the first elastomer seal and the second elastomer seal.

17. The method of claim 13, wherein the internal support comprises arms in the polymer patch system which support the polymer.

18. The method of claim 13, comprising flowing a cement slurry through the internal annulus of the polymer patch system for cementing the casing.

19. The method of claim 18, comprising flowing production fluid comprising hydrocarbon through the casing.

20. A method of isolating a loss circulation zone in a wellbore formed in a geological formation, comprising:

lowering a casing having a polymer patch system comprising a polymer layer into the wellbore to the loss circulation zone, wherein a wellbore wall of the wellbore at the loss circulation comprises the geological formation comprising a formation fracture, wherein the polymer layer comprises an exterior cylindrical polymer layer as an outside portion of the polymer patch system and having a first elastomer seal at an uphole portion of the polymer layer and a second elastomer seal at a downhole portion of the polymer layer; and activating the polymer patch system to expand the polymer layer including the first and second elastomer seals against the geological formation at the formation fracture to prevent fluid flow into the geological formation at the formation fracture to isolate the loss circulation zone while allowing flow through an internal annulus between the casing and the polymer layer, wherein an internal support is disposed in the internal annulus.

21. The method of claim 20, wherein activating comprises dropping a ball into the casing to mechanically activate the polymer patch system, or wherein activating comprises engaging a sliding sleeve on an internal diameter of the casing to mechanically activate the polymer patch system, or a combination thereof.

22. The method of claim 20, comprising flowing a cement slurry through the internal annulus of the polymer patch system for cementing the casing.

23. The method of claim 22, comprising flowing production fluid comprising hydrocarbon through the casing.

24. The method of claim 20, comprising performing primary cementation of the casing, wherein performing primary cementation comprises flowing a cement slurry through the internal annulus of the polymer patch system.

25. The method of claim 20, wherein performing primary cementation comprises cementing the casing, and wherein cementing the casing comprises disposing cement on an exterior of the casing in an annulus between the casing and the geological formation.

* * * * *